US006488190B1

(12) United States Patent
Alonzo

(10) Patent No.: US 6,488,190 B1
(45) Date of Patent: Dec. 3, 2002

(54) STRAP-SUPPORTED ARTICLE WITH MESSAGING DEVICE

(76) Inventor: Carolyn A. Alonzo, 5023 W. 64th Pl., Chicago, IL (US) 60638

( * ) Notice: Subject to any disclaimer, the term of this patent is extended or adjusted under 35 U.S.C. 154(b) by 0 days.

(21) Appl. No.: 09/764,012

(22) Filed: Jan. 17, 2001

(51) Int. Cl.[7] ..... A45C 15/00
(52) U.S. Cl. ..... 224/576; 224/647; 224/930
(58) Field of Search ..... 224/576, 647, 224/930; D3/218

(56) References Cited

U.S. PATENT DOCUMENTS

| | | | | | |
|---|---|---|---|---|---|
| 4,479,124 | A | | 10/1984 | Rodriquez et al. | |
| 4,485,276 | A | * | 11/1984 | Sato | 224/259 |
| 4,764,962 | A | * | 8/1988 | Ekman et al. | 224/259 |
| 5,315,636 | A | | 5/1994 | Patel | |
| 5,356,060 | A | | 10/1994 | Kuroda | |
| D351,943 | S | * | 11/1994 | Young | D3/216 |
| 5,409,152 | A | * | 4/1995 | Trevino | 224/259 |
| 5,613,236 | A | | 3/1997 | Tajima et al. | |
| 5,644,785 | A | * | 7/1997 | Garrett | 150/109 |
| 5,648,999 | A | | 7/1997 | Easterling et al. | |
| 5,651,049 | A | | 7/1997 | Easterling et al. | |
| 5,653,336 | A | * | 8/1997 | Buonaiuto et al. | 206/320 |
| 5,730,348 | A | | 3/1998 | Tien | |
| 5,790,680 | A | | 8/1998 | Sood | |
| 5,825,327 | A | | 10/1998 | Krasner | |
| 5,897,042 | A | | 4/1999 | Sims | |
| 5,915,609 | A | * | 6/1999 | Diakoulas | 224/625 |
| 5,961,017 | A | * | 10/1999 | Mehler | 224/153 |
| 6,000,987 | A | | 12/1999 | Belin et al. | |
| 6,032,337 | A | | 3/2000 | Rankin, Jr. et al. | |
| 6,082,600 | A | | 7/2000 | Angus et al. | |
| 6,182,878 | B1 | * | 2/2001 | Racca | 224/605 |

OTHER PUBLICATIONS

Chicago Sun–Times artice: "New Gizmo Helps Kids Get the Word Out," 2 pages, published Oct. 24, 2000.
Article: "TechSmart: Brace yourself for the newest kid," USA Weekend, published Sep. 1–3, 2000.

* cited by examiner

*Primary Examiner*—Stephen K. Cronin
(74) *Attorney, Agent, or Firm*—Law Office of Marc D. Machtinger, Ltd.

(57) ABSTRACT

A strap-supported article such as a back pack having a messaging device is disclosed. The messaging device is located in an easily accessible position on the strap of the article. The user can access the device for operation conveniently without removal of the article. The device is affixed to the strap by clipping into a slit or pocket, or by disposing within a pocket in the article. The pocket preferably includes a clear outer wall, and a user interface such as a touch plate is accessible through the clear wall. Alternatively, the device may be embedded within the strap. Operation of the device is accomplished via a record button and a recording switch for selecting between modes. Prerecorded messages are accessed by touching the touch plate, and successive touches are utilized in order to access successive prerecorded messages. Alternatively, voice activation circuitry is included to access playback of messages. The device utilizes either analog or digital recording circuitry.

22 Claims, 5 Drawing Sheets

STRAP-SUPPORTED ARTICLE WITH MESSAGING DEVICE

TECHNICAL FIELD

The present invention relates to a strap-supported article with a messaging device, and more specifically to a backpack having a message recording and playing device on the strap portion of the backpack.

BACKGROUND OF THE INVENTION

Various messaging devices are known and utilized for numerous purposes. For example, telephone answering machines allow the recording and playback of a plurality of messages. Such devices allow for the recording and playback of audio messages for multiple purposes. Many of these devices are intended to be stationary, and allow the listener to play back messages which were prerecorded at the same location, or which were recorded by remote access.

In general, most messaging devices of this sort are not designed to be carried in a manner conveniently accessible to the user. Devices have been combined with various toys and other items. In one arrangement, disclose in U.S. Pat. No. 6,000,987, issued to Belin et al., a recording device is combined with a doll or toy animal. In this arrangement, a voice activated feature allows a child's voice to be recorded. The device allows for prerecording audio recordings for a child to play back. Such an arrangement is designed mostly for amusement, and does not allow for convenience in accessing messages when away from home in an easily accessible and rememberable manner.

U.S. Pat. No. 5,648,999, issued to Easterling et al. discloses a recording device which may be embedded within a child's toy. This arrangement allows for the receipt of telephone messages at a remote device. Again, such a device is not well suited for convenience in accessibility to receive prerecorded messages. Furthermore, it is not always desirable to require that a message be recorded from a remote telephone line.

U.S. Pat No. 5,897,042, issued to Sims, discloses a back pack for a child which contains a recording device mounted to its back panel. The device is designed for amusement in that the user interface is designed to look like a simulated face. While the device allows for playback of prerecorded messages, the backpack must be removed from the user's body in order to access the recording device, and is not conveniently located so that the user could access messages while wearing the article.

It would be desirable to provide an article which is regularly worn by particular users which has a messaging device which is easily accessible to the user without removing the article, and a convenient means for receiving multiple messages.

SUMMARY OF THE INVENTION

In view of the insufficiencies discussed above, it is an object of the present invention to provide an article regularly worn by particular users to allow for prerecorded messages to be easily accessible to the user through minimal effort without removing the article from the user's body.

It is another objective of the present invention to provide a strap-supported article having a messaging device affixed to an easily accessible portion of the strap.

It is a further object of the present invention to provide a strap-supported article having a messaging device which is affixed to a portion of the strap which extends over a portion of the chest of the user in which the user can access the messages through the touch of a panel.

It is yet another object of the present invention to provide a strap-supported article having a messaging device in which multiple messages can be easily accessed through successive touches of a conveniently positioned touch panel.

It is yet a further object of the present invention to provide a strap-supported article having a messaging device which is conveniently located in such a manner that messages can be accessed or functions can be activated using voice activation technology.

In accordance with the above objectives, a strap-supported article is provided with a messaging device affixed to the strap of the article.

The strap-supported article is of the type worn regularly by an individual. In a preferred embodiment, the article is a back pack worn by a child, such as to school. The back pack is supported on the back of the user, and is supported by straps extending across the chest of the child. On one of the straps, the messaging device is positioned in such a way that the user can easily access the device with the hand opposite the strap.

The messaging device is affixed to the strap in a convenient manner. In one preferred embodiment, the device is clipped onto the strap into a slit or pocket on the strap. In another embodiment, the device is placed inside a pocket in the strap and is accessible to the used via a clear panel. The user can access a touch panel to activate the device through the clear panel. In another embodiment, the device is embedded within the strap, and accessible to the user on the outer side of the strap via openings or a clear panel. The device may be removable via an opening on the back of the strap, such as via a slit or zipper opening.

The device itself may be analog or digital, and preferably is capable of recording a plurality of messages. The recording modes may be selected via a switch such as a slide switch on the device. The listener is provided with a convenient touch panel such that a single touch will activate playback of the first recorded message, and successive touches activate playback of successive messages. A final touch may end the playback session.

The strap-supported article with messaging device is particularly suitable for use in a manner such as a parent prerecording a message or messages on the device for the child to hear later in the day, such as while on the way to school, on the way home from school, or during school. Thus, the parent might record a reminder regarding a homework assignment, lunch, an errand, etc. It is easy for the child to remember to listen to the messages due to the convenient location and accessibility of the device. The child is more likely to listen to the messages over other devices since the messages can be accessed without the need for removing the back pack from the child's back. The device is conveniently accessible for the child to record his or her own messages related to homework assignments, etc., or for a teacher to record a message for the child to bring home to a parent.

Other features and advantages of the invention will be apparent from the following detailed description taken in conjunction with the following drawings.

DETAILED DESCRIPTION OF THE PREFERRED EMBODIMENT

Figure 1:
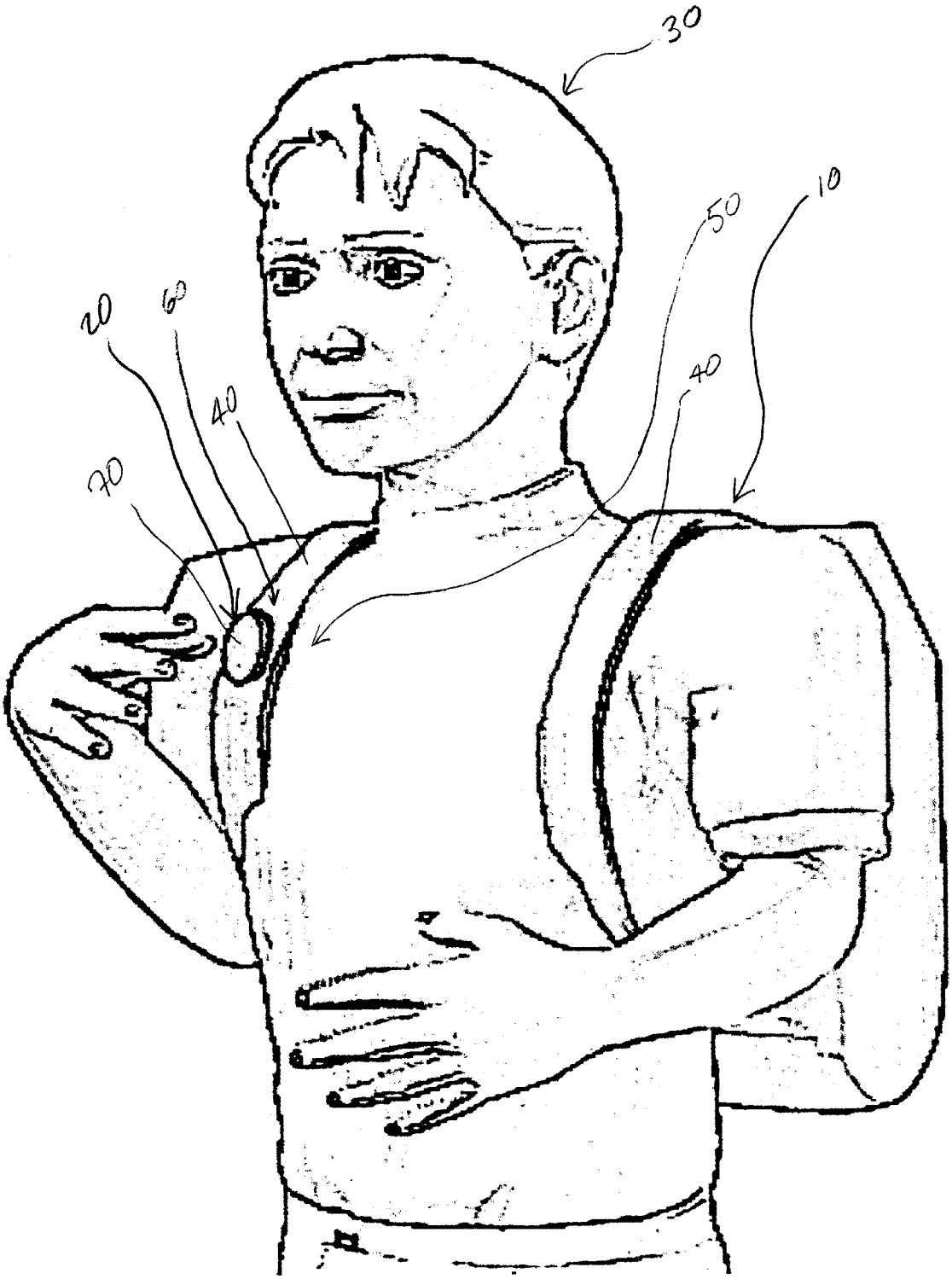
FIG. 1 is a perspective view of an individual wearing the strap-supported article of the present invention.
Figure 2:
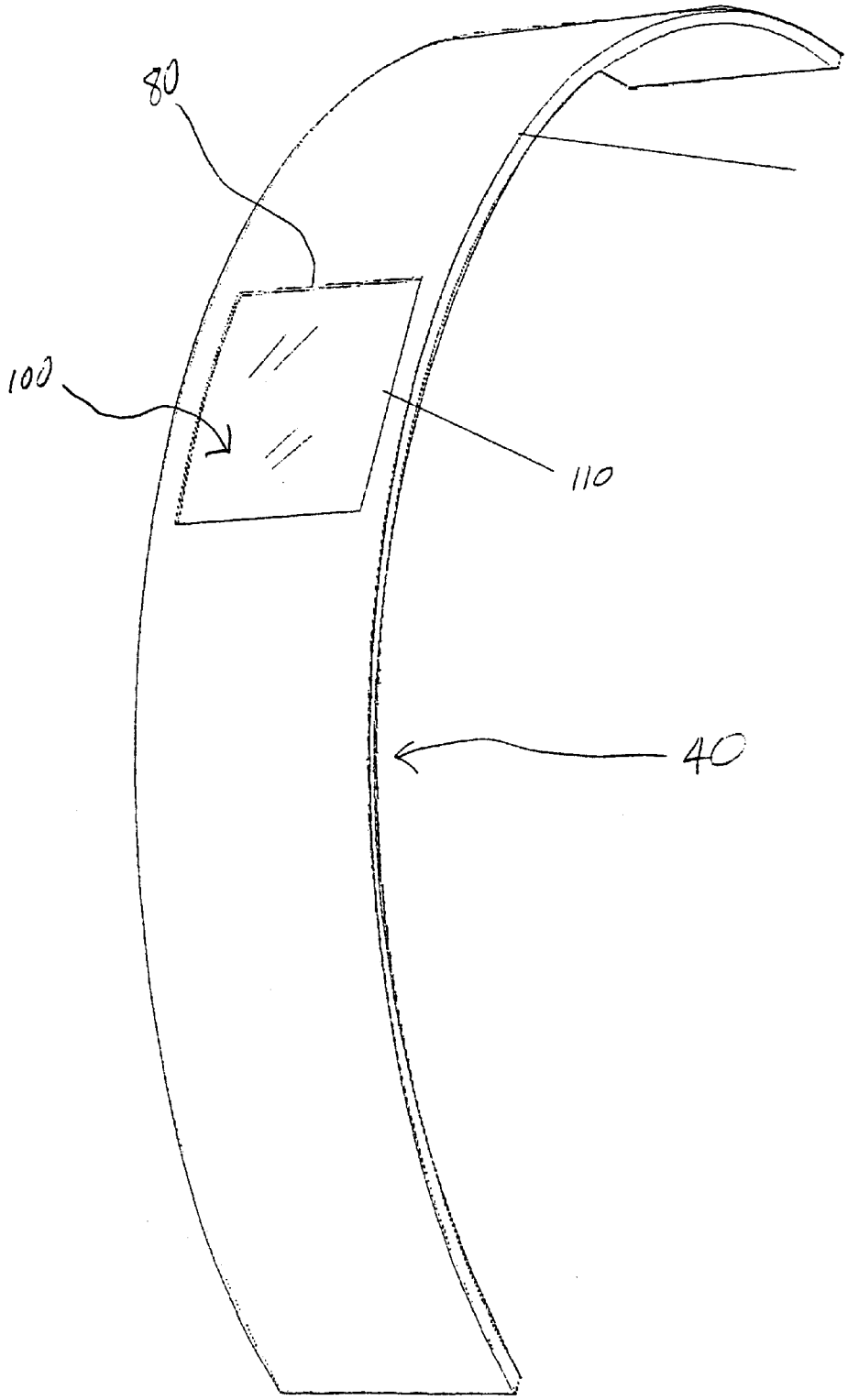
FIG. 2 is a perspective view of a preferred embodiment of the strap of the present invention.
Figure 3:
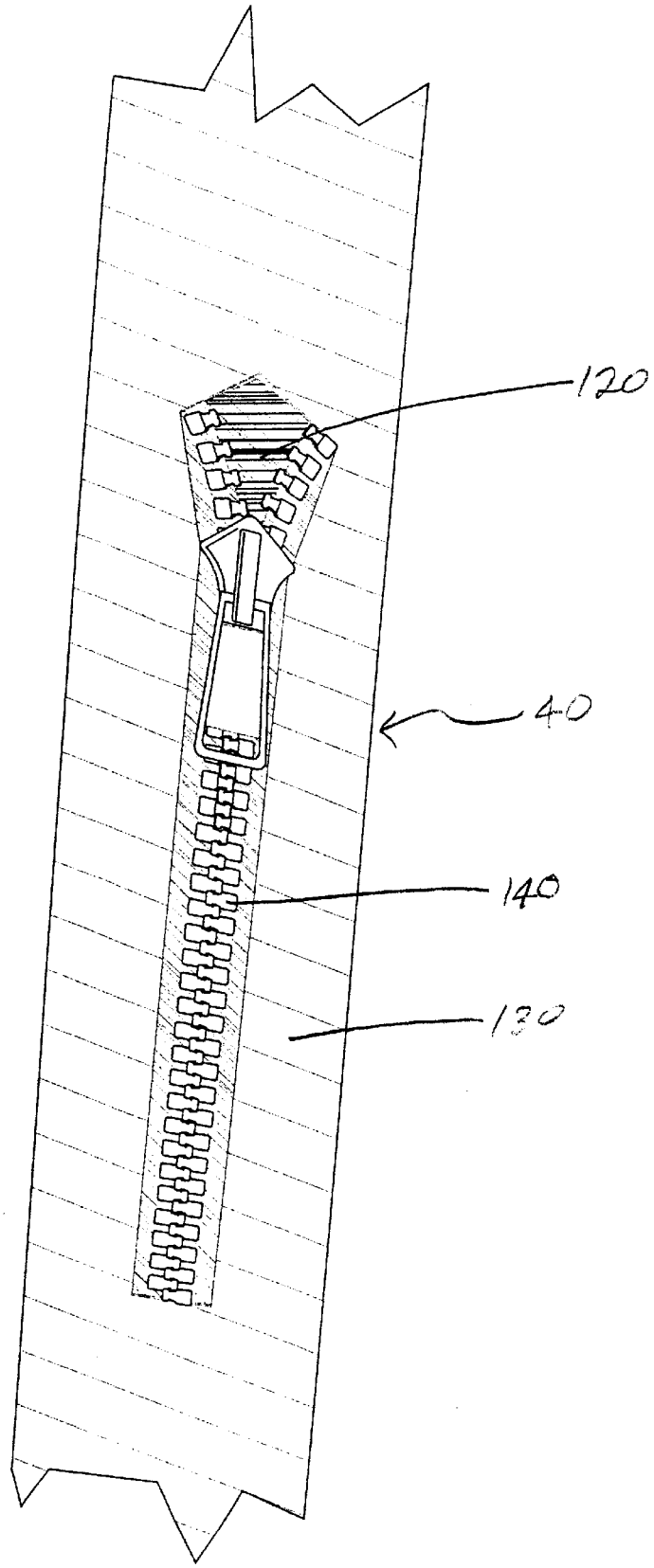
FIG. 3 is a rear view of another preferred embodiment of the strap of the present invention.
Figure 4:
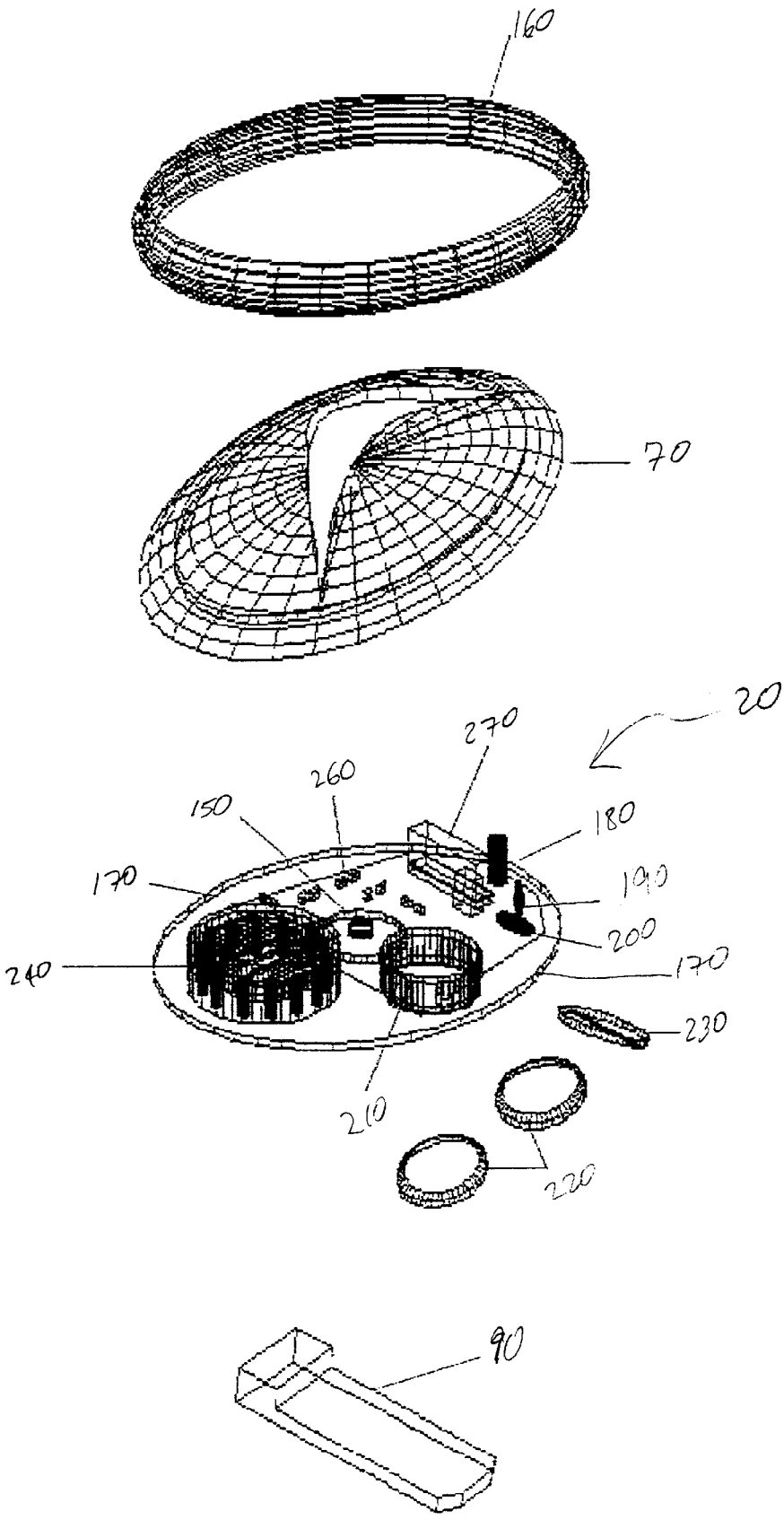
FIG. 4 is an exploded view of the messaging device of the present invention.
Figure 5:
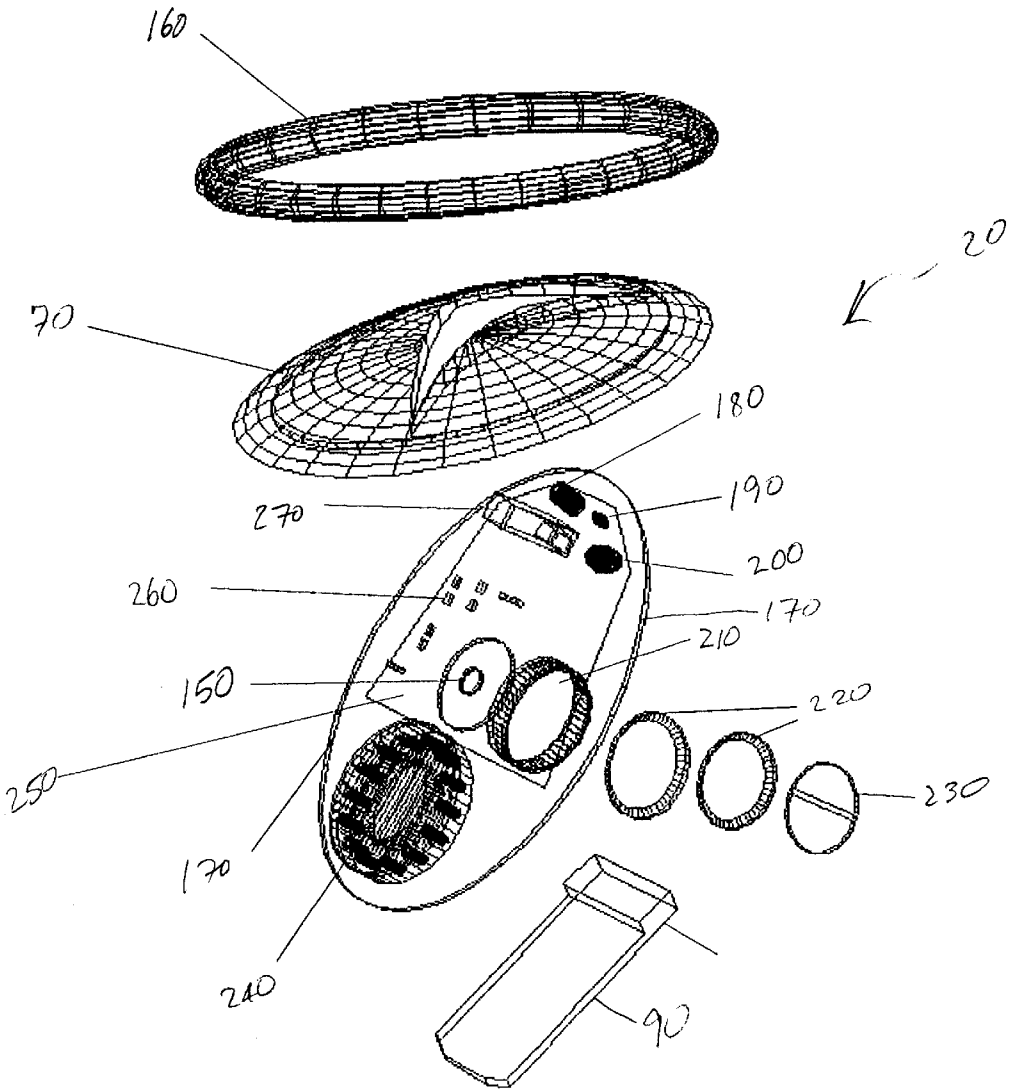
FIG. 5 is an exploded view of another embodiment of the messaging device of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A strap-supported article 10 has a messaging device 20 affixed thereto. The article 10 is of the type that is supportable on the back of a user 30 by extending straps 40. The straps 40 are adapted to extend over the chest area 50 of the individual 30 during use to support the article 10.

The messaging device 20 is affixed to at least one strap 40, and is adapted to record and play erasable audio messages. The manner of recording and playing is optionally digital or analog, however, in the preferred embodiment, digital circuitry is employed.

The messaging device 20 is preferably affixed to the strap 40, meaning attached or embedded within the strap 40, in a location which is easily accessible to the user 30. For example, the messaging device 20 may be disposed on a front portion 60 of the strap 40 so that the user 30 can access the device 20 using the hand opposite the strap 40.

The messaging device 20 preferably includes a user interface 70 facing an outer direction with respect to the strap 40 so that the user 30 can access the device 20 readily. The device 20 may be affixed to the strap 40 via a slit 80 in strap 40. The messaging device 20 optionally includes a clip portion 90 adapted to extend through the slit 80 in order to affix the messaging device 20 to the strap 40. In an alternate embodiment, the device 20 is placed inside a pocket portion 100 within strap 40. The pocket 100 preferably includes a clear outer wall 110 such that the user can see the user interface 70 and operate the device 20 through the wall 110.

In an alternate embodiment, the messaging device 20 is embedded within the strap 40. The device may be removable, and is accessible via a slit or opening 120 on the rear side 130 of strap 40. The opening 120 may be sealable such as by zipper 140. Alternatively, the opening 120 could be held shut via a hook and loop fastener, or any other suitable fastening device. Thus, the device 20 may be removed for recording purposes, or to replace batteries.

The device 20 preferably includes a push button 150 which functions as a playback switch and may be operable by applying pressure to the user interface or touch plate 70. The playback feature preferably functions in such a manner that a first touch of the plate 70 accesses playback of a first recorded message, a second touch accesses playback of a second message, etc., and a final touch may end playback. Alternatively, the features of the device 20, such as playback, may be activated via voice sensing or voice activation circuitry.

In a preferred embodiment, the article 10 is a back pack or book bag 10 carried on the back of a user 30, such as a child. The user can easily access the device 20 while wearing the back pack 10 on the user's back.

The messaging device 20 includes components for carrying out recording and playback tasks, and for structurally encompassing the device 20. In one preferred embodiment, the device 20 includes touch plate 70, a retaining ring 160 to hold the plate 70 into place with respect to base 170. Positioned on base 170 are recording means and playback circuitry. Preferably, the device 20 includes push button 150, a microphone 180, an optional record LED 190, record button 200, battery holder 210, batteries 220 such as lithium cells, a battery cover 230, a speaker 240, circuit board 250, recording chips 260, and a recording switch 270. Recording switch 270 may have a plurality of positions, and may be a slide switch 270 for selecting between different recording modes. In a preferred embodiment, the recording switch 270 includes three positions for recording three separate messages for separate playback. Thus, operation of the device 20 preferable would be accomplished by placing recording switch 270 into one of three modes, depressing record button 200 to record an audio message, recording additional messages in other modes if desired. Playback is accomplished by touching plate 70 once to playback a first message, touching plate 70 a second time to playback a second message, etc. Alternatively, touch plate 70 may have a plurality of touch areas to allow a user to select a message for playback by touching the appropriate corresponding area.

While the specific embodiments have been illustrated and described, numerous modifications come to mind without significantly departing from the spirit of the invention, and the scope of protection is only limited by the scope of the accompanying claims.

What is claimed is:

1. A strap-supported article having a messaging device comprising:

an article adapted to removably store objects to be supported on the back of an individual by at least one strap, wherein said at least one strap is adapted to be extended over the chest area of the individual during use, and a messaging device affixed to said at least one strap adapted to record and play erasable audio messages, wherein said messaging device has a user interface disposed on said strap separated by a distance from said article.

2. The strap-supported article according to claim 1, wherein said messaging device is positioned on said at least one strap in a location easily accessible to such an individual.

3. The strap-supported article according to claim 2, wherein said user interface faces an outer direction with respect to said at least one strap.

4. The strap-supported article according to claim 2, wherein said at least one strap further comprises a slit, and wherein said messaging device comprises a clip portion adapted to extend through said slit in order to affix said messaging device to said at least one strap.

5. The strap-supported article according to claim 2, wherein said messaging device comprises functions which are voice activated.

6. The strap-supported article according to claim 2, wherein said at least one strap comprises a pocket, and wherein said messaging device is disposed within said pocket.

7. The strap-supported article according to claim 6, wherein said pocket comprises a clear outer wall and wherein said user interface is operable through said clear outer wall.

8. The strap-supported article according to claim 2, wherein said messaging device in embedded within said at least one strap.

9. The strap-supported article according to claim 8, wherein said messaging device is accessible through a zipper opening on an inner side of said at least one strap.

10. The strap-supported article according to claim 2, wherein said messaging device comprises a push button for operating a function of said messaging device.

11. The strap-supported article according to claim 10, wherein said push button selectively accesses a playback function.

12. The strap-supported article according to claim 11, wherein said messaging device is adapted to record a plurality of messages, and wherein repeated activation of said push button accesses a plurality of prerecorded messages successively.

13. The strap-supported article according to claim 10, wherein said push button is selectively activated upon pressure being applied to an adjacent outer touch plate.

14. The strap-supported article according to claim 13, wherein said touch plate is disposed toward the outer side of said at least one strap and wherein said touch plate is easily accessible to such an individual.

15. A strap-supported backpack having a messaging device comprising:

at least one strap adapted to extend over the chest area of an individual, a messaging device affixed to said at least one strap adapted to record and play erasable audio messages, wherein said messaging device has a user interface disposed on said strap separated by a distance from said article.

16. The strap-supported backpack according to claim 15, wherein said user interface of said messaging device is disposed in a location easily accessible to such an individual.

17. The strap-supported backpack according to claim 16, wherein said user interface comprises a touch plate.

18. The strap-supported backpack according to claim 17, wherein said touch plate is disposed outside of and on an outer surface of said at least one strap.

19. The strap-supported backpack according to claim 17, wherein said touch plate is disposed within said strap directly under a clear surface disposed on an outer surface of said strap.

20. The strap-supported backpack according to claim 17, wherein said touch plate selectively accesses a plurality of prerecorded messages sequentially upon repeated activation of said touch plate.

21. The strap-supported backpack according to claim 20, wherein said messaging device further comprises a recording switch having a plurality of positions for selectively recording separate messages.

22. A strap-supported backpack having a messaging device comprising:

at least one strap adapted to extend over the chest area of an individual, a messaging device affixed to said at least one strap adapted to record and play erasable audio messages, said messaging device being affixed to said strap in a location easily accessible to such an individual, wherein said messaging device comprises a touch plate which activates a playback function of said device, successive activation of said touch plate activating successive prerecorded messages, and means for selectively recording a plurality of messages for storage within said device.

* * * * *